US006312308B1

(12) United States Patent
Chen

(10) Patent No.: US 6,312,308 B1
(45) Date of Patent: Nov. 6, 2001

(54) MOTION DISPLAY TOY

(76) Inventor: Kun Yueh Chen, No. 18, Alley 7 Lane 39 Kuo-Tai Street, Panchiao, Taipei (TW)

( * ) Notice: Subject to any disclaimer, the term of this patent is extended or adjusted under 35 U.S.C. 154(b) by 0 days.

(21) Appl. No.: 09/491,701

(22) Filed: Jan. 26, 2000

(30) Foreign Application Priority Data

Jul. 14, 1999 (TW) ..... 85211769
Sep. 16, 1999 (TW) ..... 88211769A01

(51) Int. Cl.[7] ..... A63H 11/00; A63H 11/06

(52) U.S. Cl. ..... 446/352; 446/311; 428/3; 40/410

(58) Field of Search ..... 446/352, 353, 446/330, 332, 308, 309, 310, 311, 320, 487; 428/3; 40/410, 415

(56) References Cited

U.S. PATENT DOCUMENTS 1,559,424 * 10/1925 Hay ..... 446/310
3,566,504 * 3/1971 Grandy, Jr. ..... 446/308 X
3,695,148 * 10/1972 Baginski et al. ..... 446/308 X
3,895,441 * 7/1975 Horak ..... 446/310 X
4,076,234 * 2/1978 Burnbaum ..... 40/410 X
5,145,446 * 9/1992 Kuo ..... 446/487 X
5,765,234 * 6/1998 Lo ..... 446/352 X
5,839,939 * 11/1998 Ohi ..... 446/320 X
5,941,755 * 8/1999 Danielian ..... 446/353 X
6,210,250 * 4/2001 Sui ..... 446/358

* cited by examiner

*Primary Examiner*—D. Neal Muir
(74) *Attorney, Agent, or Firm*—Pro-Techtor International Services

(57) ABSTRACT

A motion display toy, which includes a housing having a top cover and a top center opening at the top cover, two sliding door panels moved to close/open the center opening at the top cover, a telescopic device mounted inside the housing and driven to extend out of the top center opening, an annular rotary member decorated with ornaments and rotated around the top center opening, first drive means controlled by the control circuit to move the sliding door panels, second drive means controlled by the control circuit to move the telescopic device between extended position and retracted position, and third drive means controlled by the control circuit to rotate the annular rotary member.

12 Claims, 12 Drawing Sheets

MOTION DISPLAY TOY

BACKGROUND OF THE INVENTION

The present invention relates to a motion display toy, and more particularly to such a motion display toy, which uses first drive means to open/close a top center opening, second drive means to move a telescopic device between an extended position and a retracted position, and third drive means to rotate an annular rotary member around the top center opening.

A variety of ornamental display toys have been disclosed, and have appeared on the market. People may purchase these ornamental display toys as birthday gifts, Christmas gifts, etc., to show one's best regards to others. However, these static ornamental display toys are less attractive. In order to attract people, motion display toys have become more and more popular.

SUMMARY OF THE INVENTION

It is the main object of the present invention to provide a motion display toy, which moves installed ornaments, and produces sound and light effects when moving the ornaments. According to the present invention, the motion display toy comprises a housing having a top cover and a top center opening at the top cover, two sliding door panels moved to close/open the center opening at the top cover, a telescopic device mounted inside the housing and driven to extend out of the top center opening, an annular rotary member decorated with ornaments and rotated around the top center opening, first drive means controlled by the control circuit to move the sliding door panels, second drive means controlled by the control circuit to move the telescopic device between extended position and retracted position, third drive means controlled by the control circuit to rotate the annular rotary member, flashing circuit means controlled by the control circuit to flash lamps decorated on the annular rotary member and the telescopic device, and voice recording and reproduction circuit means controlled by the control circuit to record voices and to reproduce recorded voices.

DETAILED DESCRIPTION OF THE PREFERRED EMBODIMENTS

Figure 1:
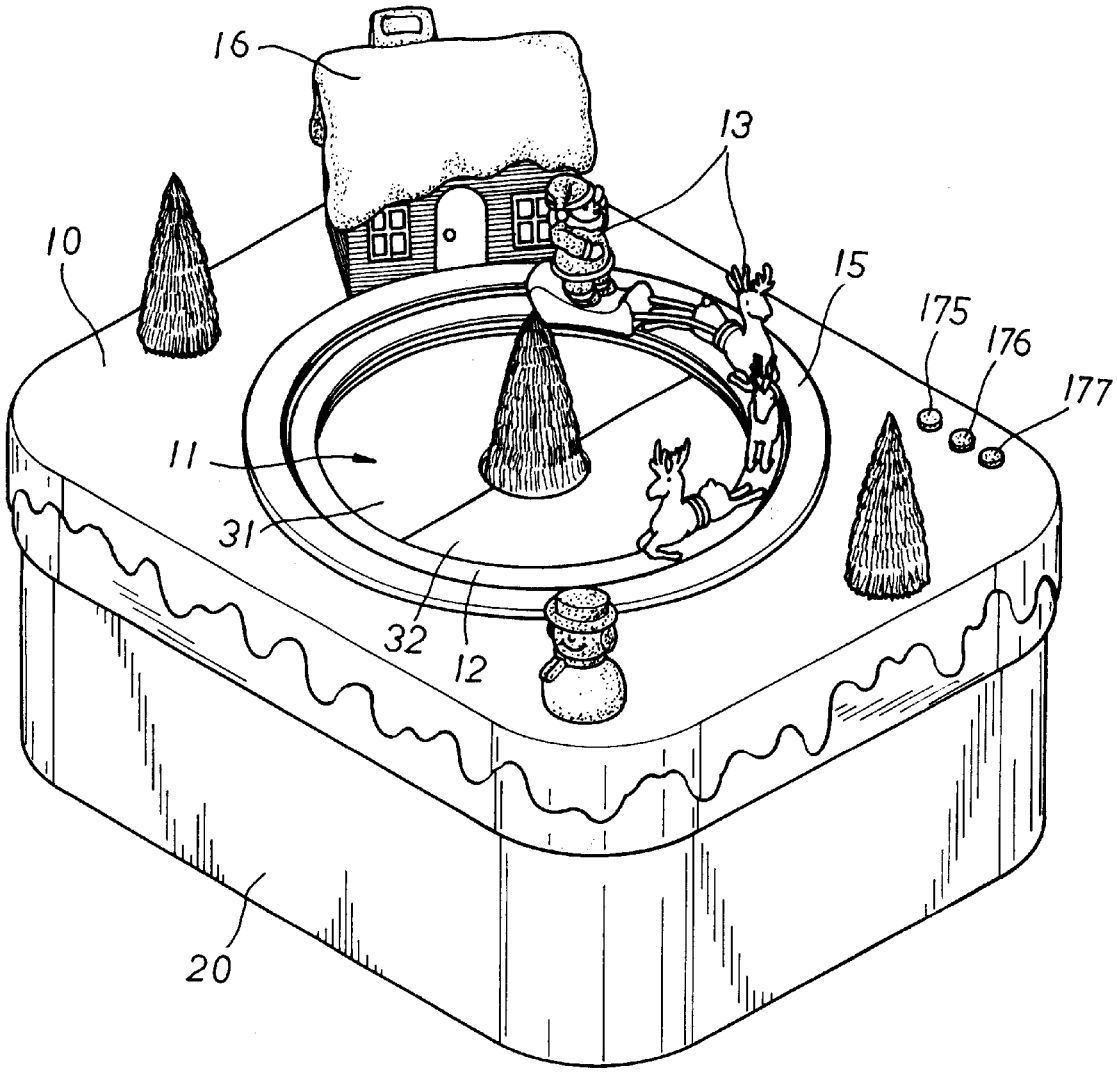
FIG. 1 is an elevational view of a motion display toy according to a first embodiment of the present invention.

Referring to FIGS. from 1 through 6, a motion display toy in accordance with a first embodiment of the present invention is shown comprised of a housing formed of a top cover 1 and a casing 20, a first drive unit 30, a second drive unit 40, a third drive unit 50, and a control circuit 60.

Figure 5:
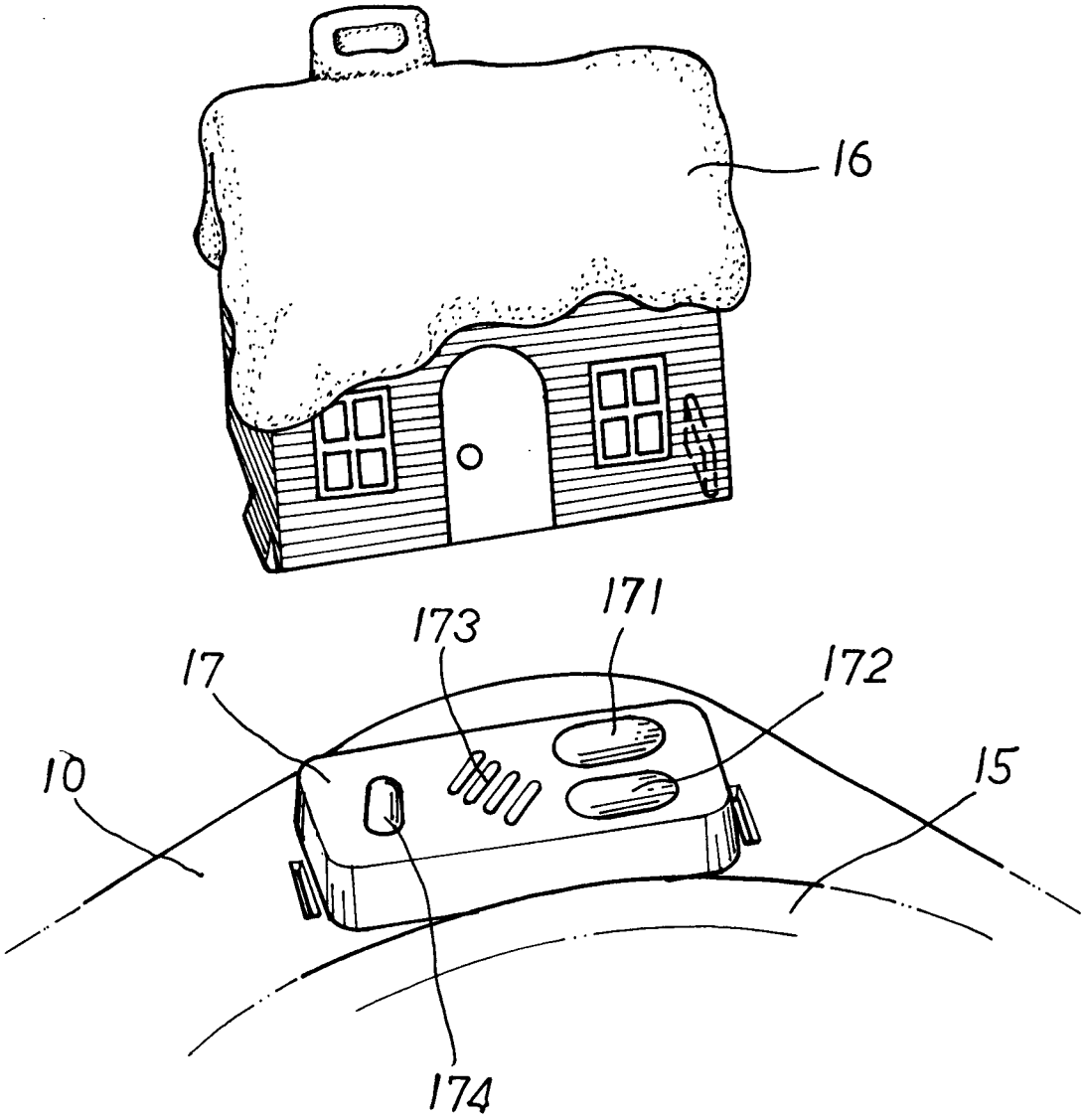
FIG. 5 illustrates the arrangement of the switch box at the top cover and the relationship between the ornamentals hell and the switch box according to the present invention.

The top cover 10 comprises a center opening 11, an annular track 15 provided around the center opening 11, an annular rotary member 12 supported on supporting elements 14 in the annular track 15 and rotated by the third drive unit 50, a plurality of ornaments (for example, Santa Claus, deer sleigh, and deer) 13 fixedly supported on the rotary member 12 at the top, a switch box 17 at the top side wall thereof near one corner (see FIG. 5), a an ornamental shell 16 covered on the switch box 17, and a plurality of control buttons 175, 176 and 177 provided at the top side wall remote from the switch box 17. The switch box 17 comprises a power button 171, a record button 172, a microphone 173, and a play button 174. The control buttons 175~177 and the switch box 17 are respectively connected to the control circuit 60 in the casing 20. Decorative lamps may be mounted on the top cover 10 at different locations.

The top cover 10 and the casing 20 are fixedly fastened together by screws. The casing 20 comprises a battery box 21 on the inside at the bottom, and a battery 70 installed in the battery box 21 (see FIG. 2).

Figure 2:
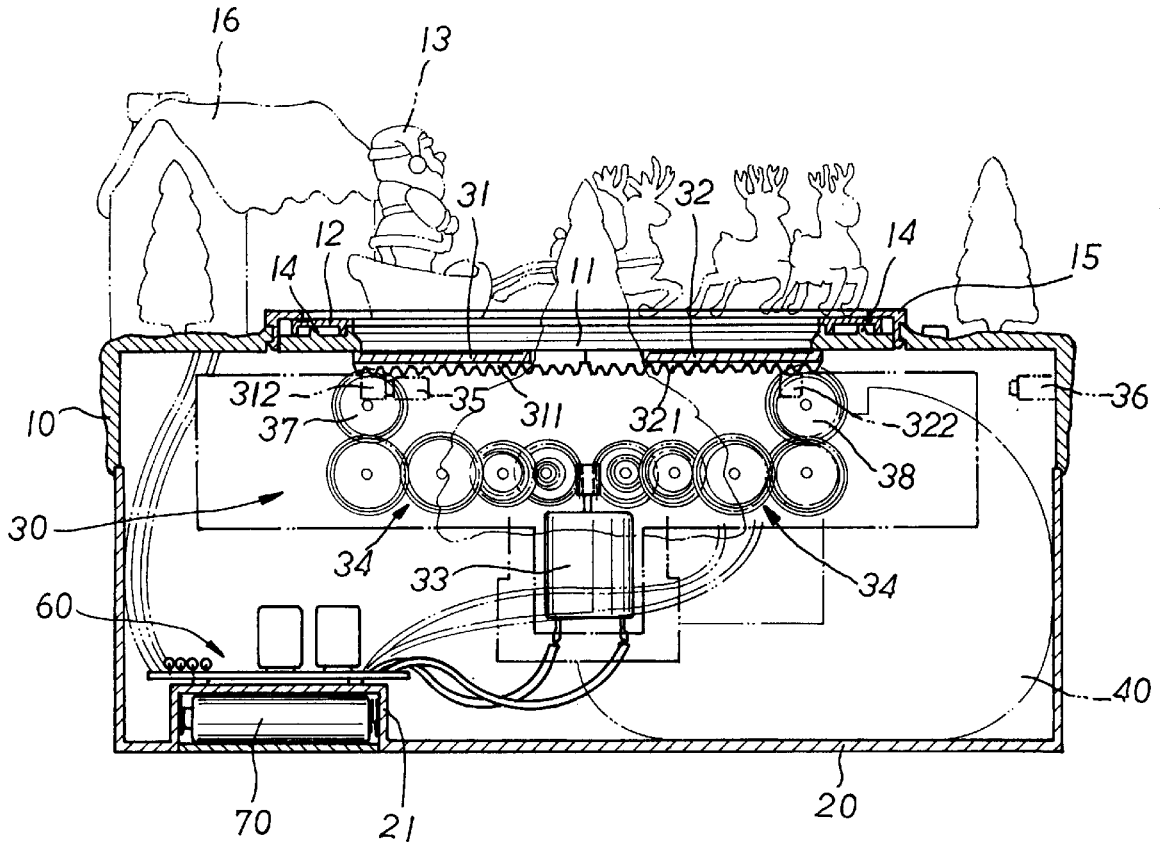
FIG. 2 is a sectional view showing the arrangement of the first drive unit in the housing of the motion display toy according to the present invention.

Referring to FIG. 2, the first drive unit 30 is mounted inside the casing 20 at the top near the front side, comprising two sliding door panels 31 and 32 moved relative each other to close/open the center opening 11 at the top cover 10, a motor 33, two reduction gear sets 34 symmetrically disposed at two opposite sides and driven to rotate in reversed directions by the motor 33, two racks 311 and 321 respectively and fixedly fastened to the sliding door panels 31 and 32 at the bottom side, two driven gears 37 and 38 respectively meshed between the reduction gear sets 34 and the racks 311 and 321, two micro switches, namely, the first micro switch 35 and the second micro switch 36, and two actuating rods, namely, the first actuating rod 312 and the second actuating rod 322 respectively and fixedly provided at the sliding door panels 31 and 32 and moved within the sliding door panels 31 and 32 relative to the micro switches 35 and 36. The motor 33 and the micro switches 35 and 36 are respectively connected to the control circuit 60. When the sliding door panels 31 and 32 are closed, the sliding door panels 31 and 32 define a circular hole at the center, the first actuating rod 312 is pressed on the first micro switch 35, and the second actuating rod 322 is spaced from the second micro switch 36 at a distance. On the contrary, when the sliding door panels 31 and 32 are opened, the first actuating rod 312 is spaced from the first micro switch 35 at a distance, and the second actuating rod 322 is pressed on the second micro switch 36.

Figure 3:
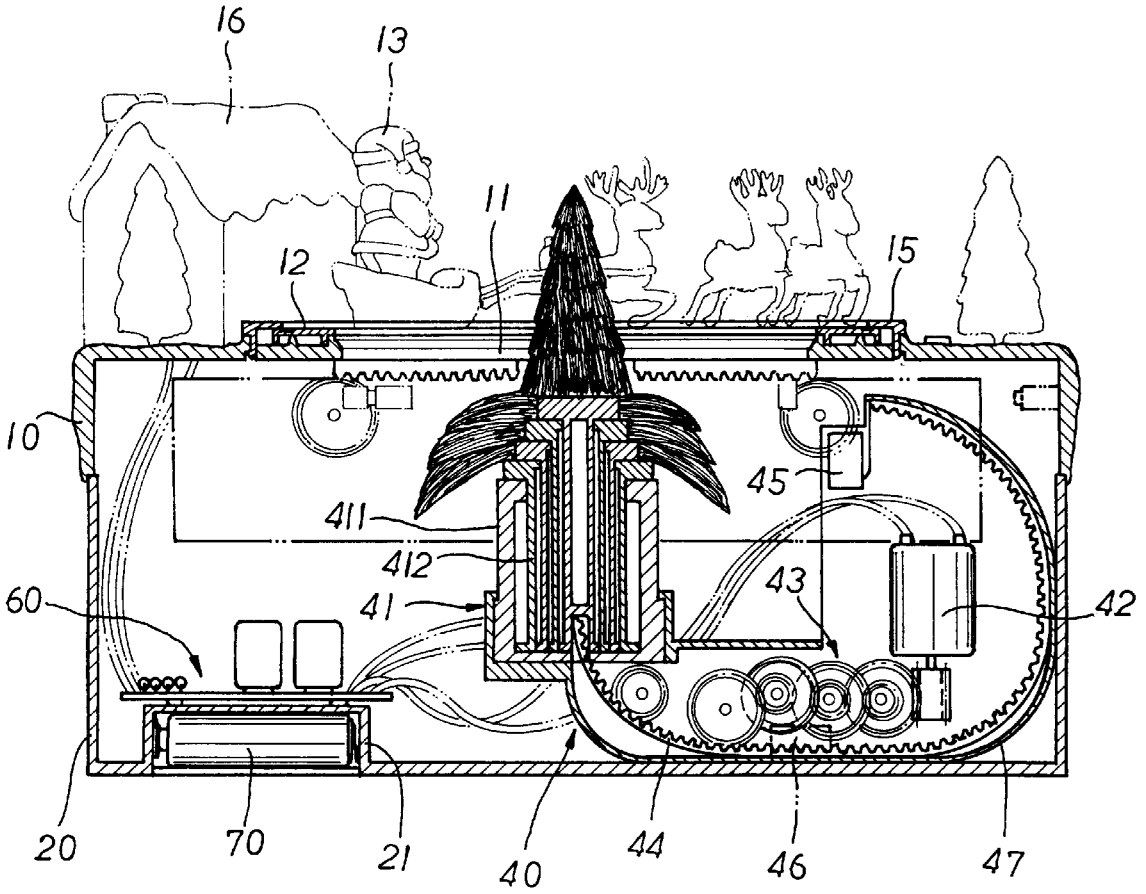
FIG. 3 is a sectional view showing the arrangement of the second drive unit in the housing of the motion display toy according to the present invention.

Referring to FIG. 3, the second drive unit 40 is mounted inside the casing 20 at the middle, comprising a telescopic device 41, a reversible motor 42, a flexible rack 44 coupled to the telescopic device 41, a rack guide 47, a reduction gear set 43 driven by the motor 42 to move the flexible rack 44 along the rack guide 47, a first micro switch 45 and a second micro switch 45 respectively disposed at one side of the path of the flexible rack 44 near two opposite ends. The telescopic device 41 comprises a hollow base 411, and a telescopic rod 412 mounted in the hollow base 411 and made with parts that slide one inside another. A conical twig and bundles of twigs are respectively mounted on the top end of the smallest part of the telescopic rod 412 and the top edge of each of the other parts of the telescopic rod 412. Normally, the conical twig at the smallest part of the telescopic rod 41 is extended out of the circular hole defined in between the door panels 31 and 32. When the motor 42 is started to turn the reduction gear set 43 in one direction, the flexible rack 44 is moved by the reduction gear set 43 along the rack guide 47 in one direction, thereby causing telescopic rod 412 to be extended out. On the contrary, when the reversible motor 42 is rotated in the reversed direction, the flexible rack 44 is moved by the reduction gear set 43 to retract the telescopic rod 412. The motor 42 and the micro switches 45 and 46 are respectively connected to the control circuit 60. When the telescopic rod 412 is received inside the hollow base 411, the rear end of the rack 44 is pressed on the micro switch 45, and one side of the rack 44 is pressed on the micro switch 46. When the telescopic rod 412 is extended out, the rack 44 is moved away from the micro switches 45 and 46.

Figure 4:
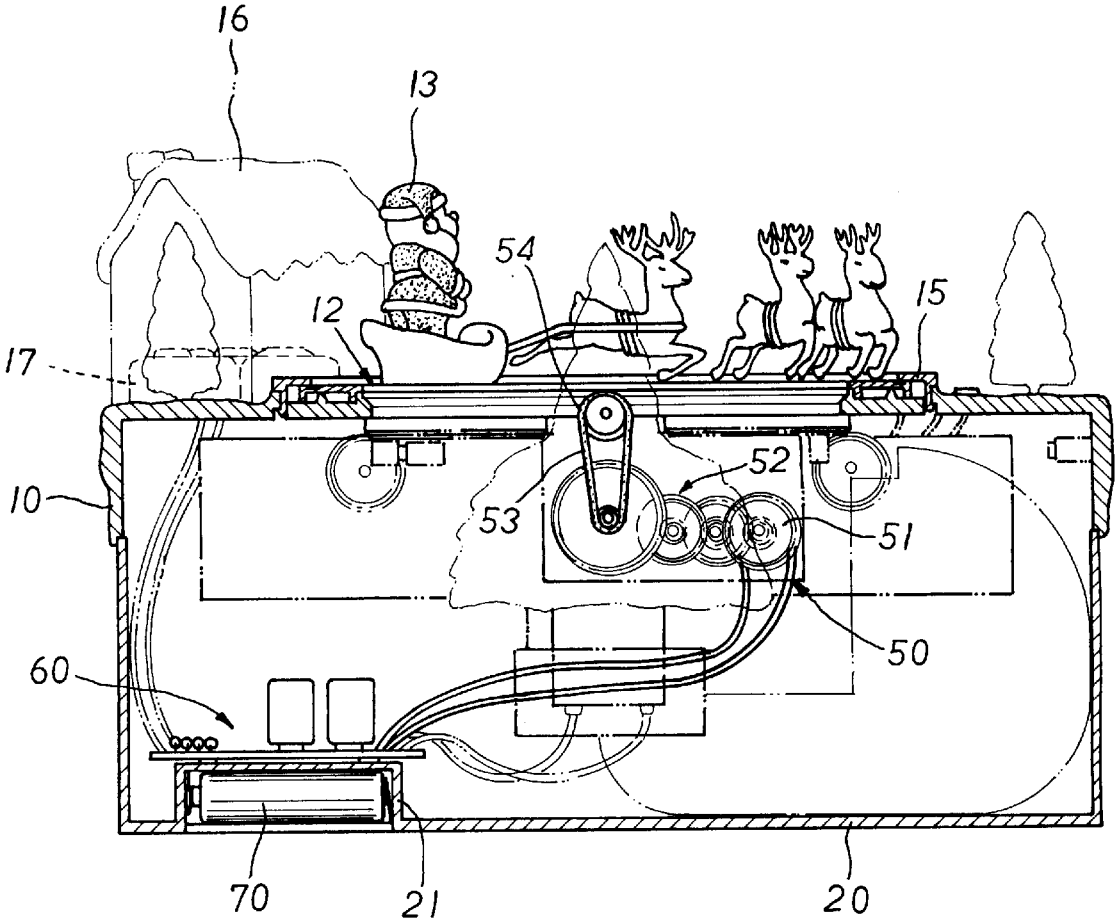
FIG. 4 is a sectional view showing the arrangement of the third drive unit in the housing of the motion display toy according to the present invention.

Referring to FIG. 4, the third drive unit 50 is mounted inside the casing 20 at the top near the rear side, comprising a reversible motor 51, a reduction gear set 52 driven by the motor 51, a wheel 54 driven to rotate the annular rotary member 12, and a transmission belt 53 coupled between the reduction gear set 52 and the wheel 54.

Figure 6:
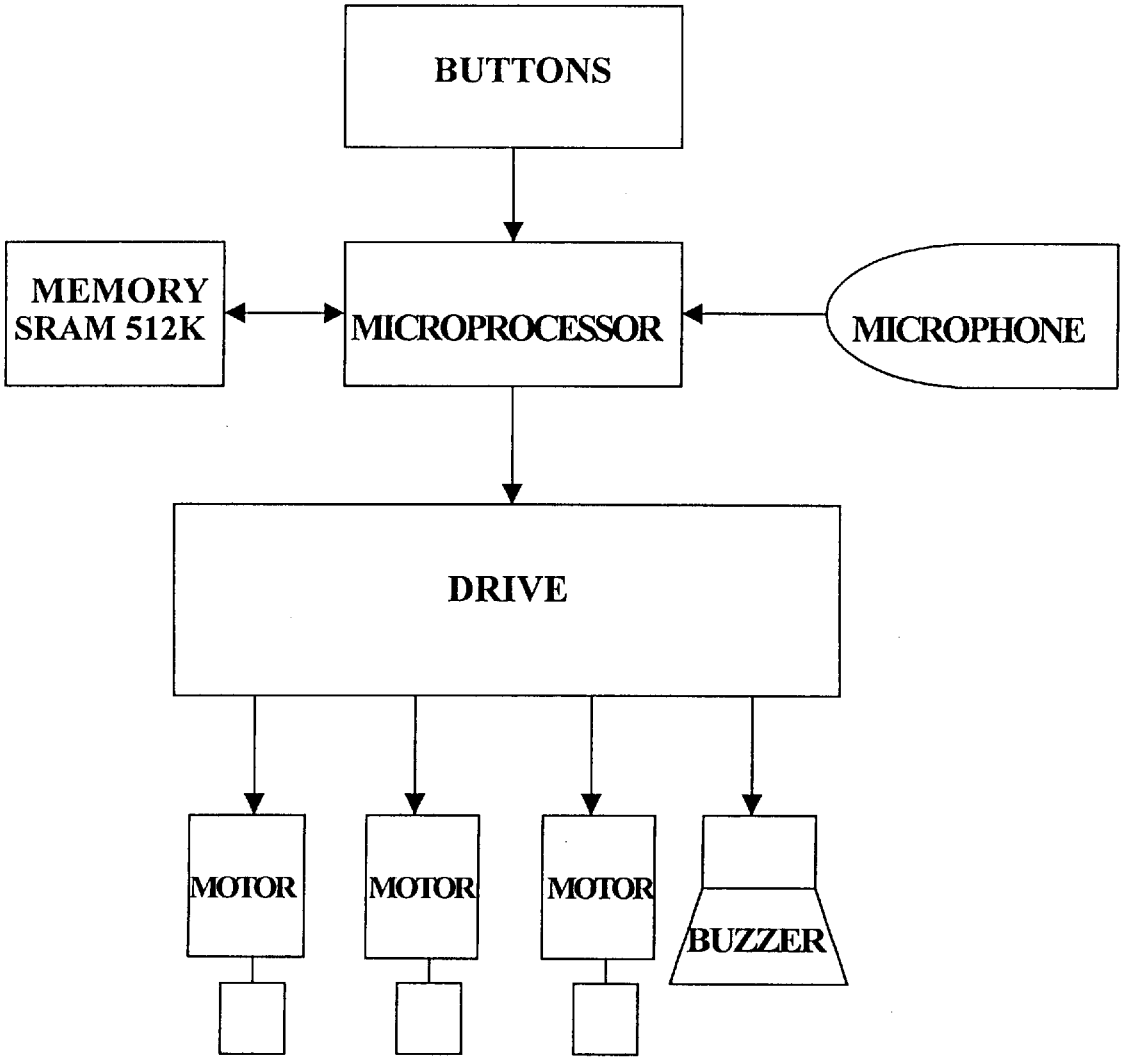
FIG. 6 is a control circuit block diagram according to the present invention.

Referring to FIG. 6 and FIGS. from 2 through 4 again, the control circuit 60 is mounted inside the casing 20 above the battery box 21, comprising circuit means for controlling the operation of the motors 33, 43 and 51, voice recording and playing circuit means for recording message and music and reproducing recorded message and music, light emitting circuit means for controlling the operation of lamp bulbs installed in the ornaments 13 and the ornamental shell 16 at the top cover 10.

Figure 7:
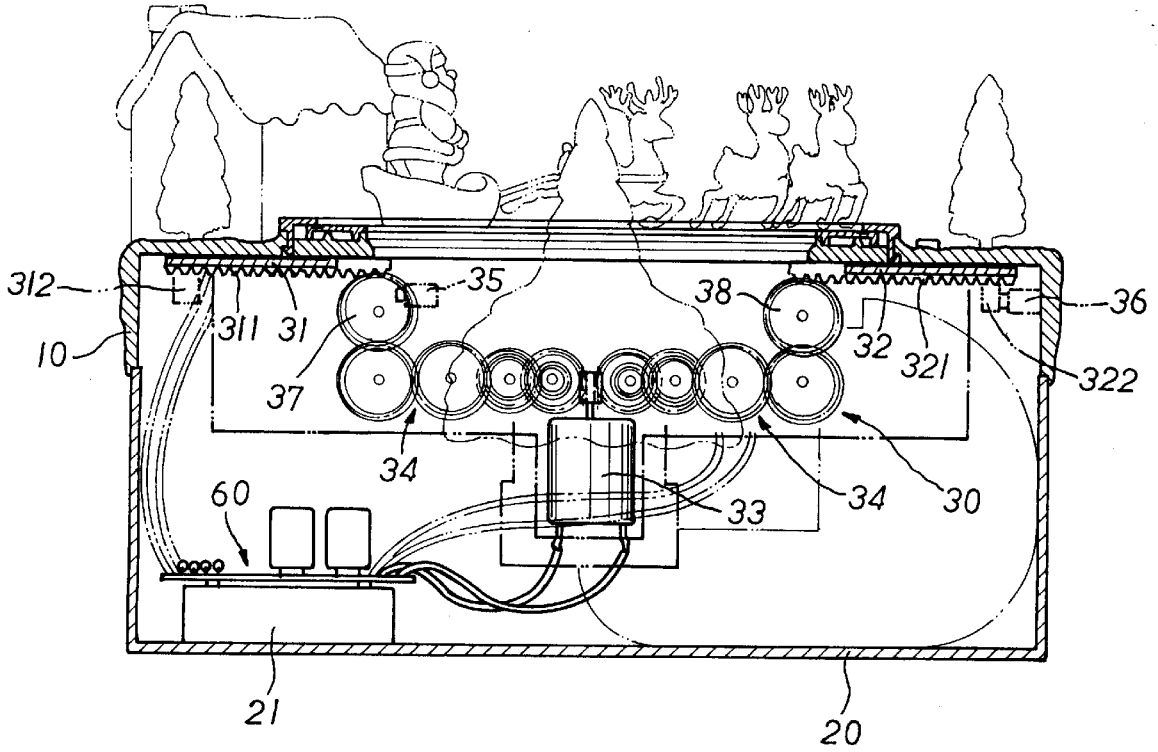
FIG. 7 is similar to FIG. 2 but showing the sliding door panels opened.
Figure 8:
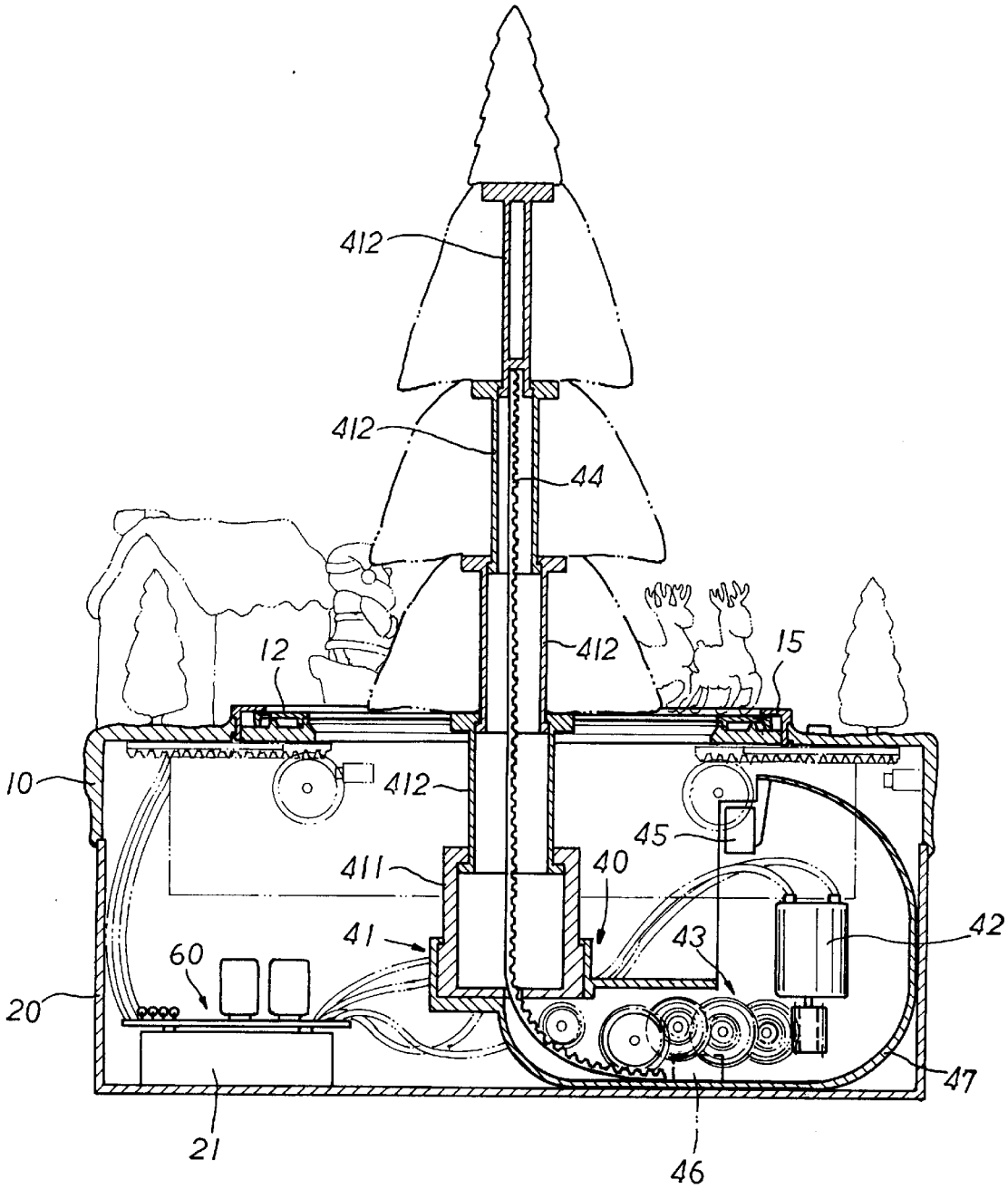
FIG. 8 is a sectional view of the present invention, showing the telescopic rod extended out of the top cover of the housing.
Figure 9:
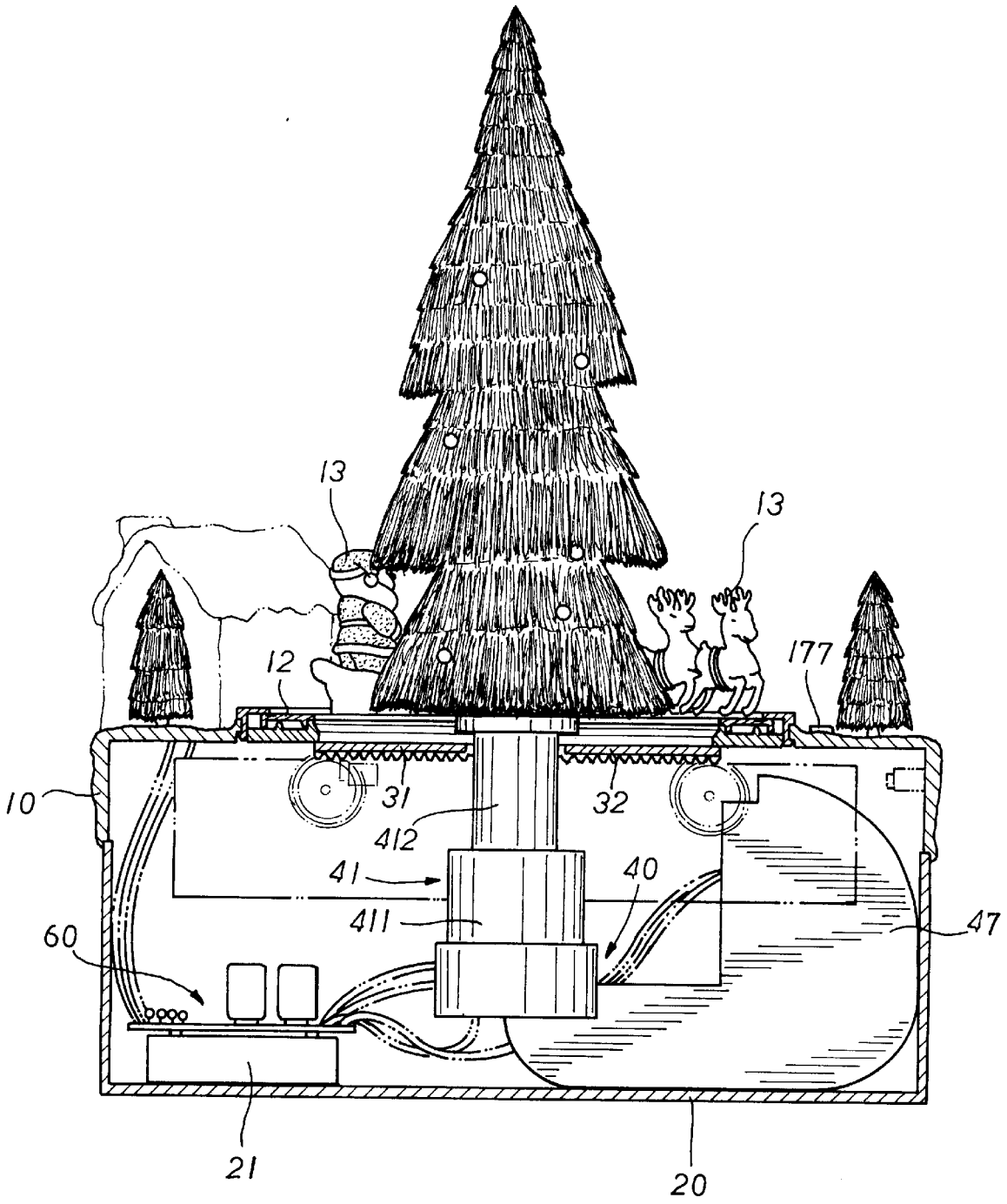
FIG. 9 illustrates the telescopic rod extended out of the top cover of the housing, the sliding door panels closed, the annular rotary member rotated according to the present invention.

Referring to FIGS. from 1 through 5 again, when in use, the ornamental shell 16 is opened, and then the power button 171 is clicked to switch on power supply, enabling the control circuit 60 to work. When turned on, the user can use the record button 172 to record a (blessing) message. When the play button 174 is clicked, the previously recorded message is reproduced. The motion display toy can be used as a gift, and the person who bought the motion display toy can record a message before presenting it to another person. After the power button 171 has been switched on, the ornamental shell 16 is closed again. The user can operate the control buttons 175, 176 and 177 to achieve different functions. For example, when the control button 177 is clicked, the control circuit 60 is triggered to drive the motor 33 of the first drive unit 30, causing the sliding door panels 31 and 32 moved by the reduction gear sets 34 through the driven gears 37 and 38 in opening the center opening 11 (see FIG. 7). When the sliding door panels 31 and 32 are fully opened, the second actuating rod 322 is forced to trigger the second micro switch 36, causing the second micro switch 36 to turn on the motor 42 of the second drive unit 40 and the music IC in the control circuit 60. When the motor 42 of the second drive unit 40 is started, the rack 44 is moved forwards by the reduction gear set 43 to extend the twig-decorated telescopic rod 412 out Of the opening 11 at the top cover 10, thereby causing a Christmas tree to be shown above the top cover 10. After the telescopic rod 412 has been fully extended out, the rack 44 is released from the micro switches 45 and 46, causing the micro switches 45 and 46 to start the motor 51 of the third drive unit 50, to drive the control circuit 60 in flashing the lamps at the ornaments 13 and related decorative items above the top cover 10, and simultaneously to reverse the first drive unit 30 in closing the sliding door panels 31 and 32 (see FIG. 9). When starting the motor 51, the wheel 54 is rotated by the reduction gear set 52 through the transmission belt 53, causing the annular rotary member 12 to be rotated in the annular track 15. Therefore, the ornaments 13 are moved with the rotary member 12, and turned about the Christmas tree formed of the twig-decorated telescopic rod 412.

When turning off the motion display toy, the button 177 is clocked again to give a signal to the control circuit 60, causing the control circuit 60 to turn off the motor 51 of the third drive unit 50, the music IC and the flashing circuit, and to turn on the motor 33 of the first drive unit 30 in opening the sliding door panels 31 and 32, then to reverse the motor 43 of the second drive unit 40 in retracting the telescopic rod 412, and then to drive the motor 33 of the first drive unit 30 in closing the sliding door panels 31 and 32.

Figure 10:
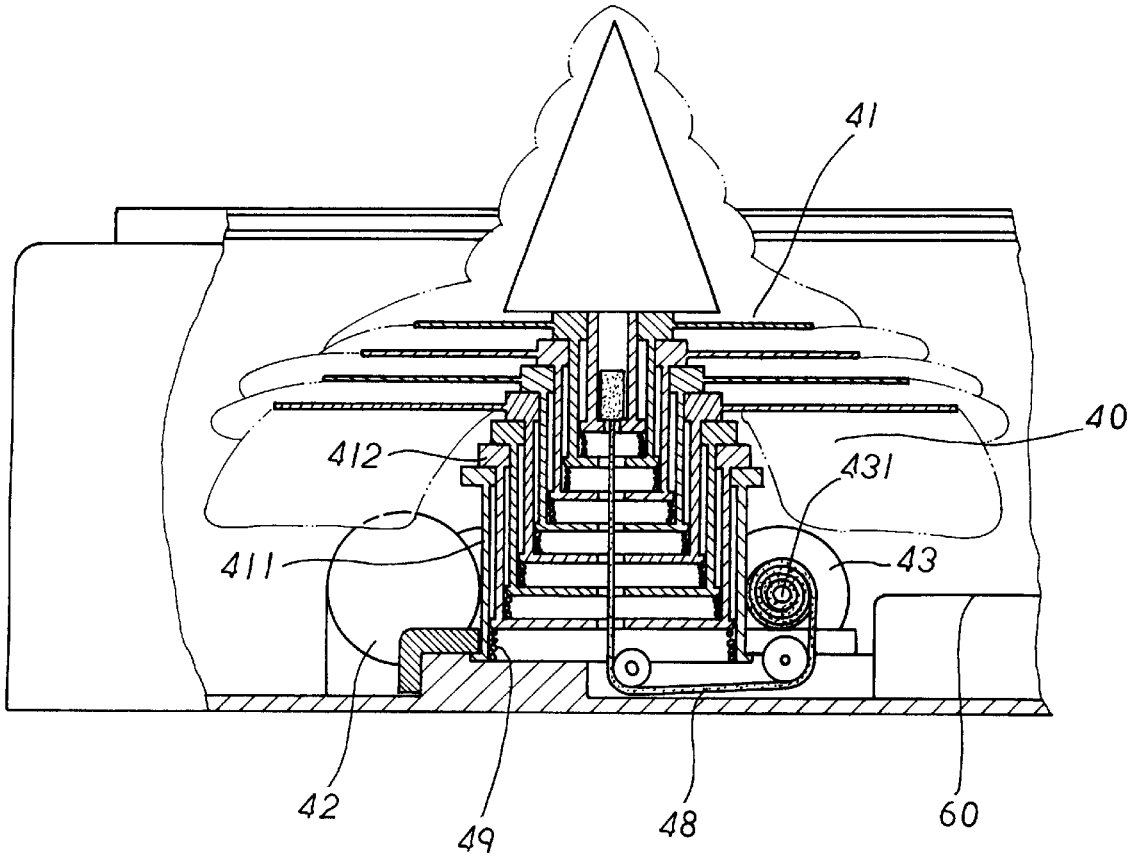
FIG. 10 is a sectional plain view showing an alternate form of the second drive unit according to the present invention.
Figure 11:
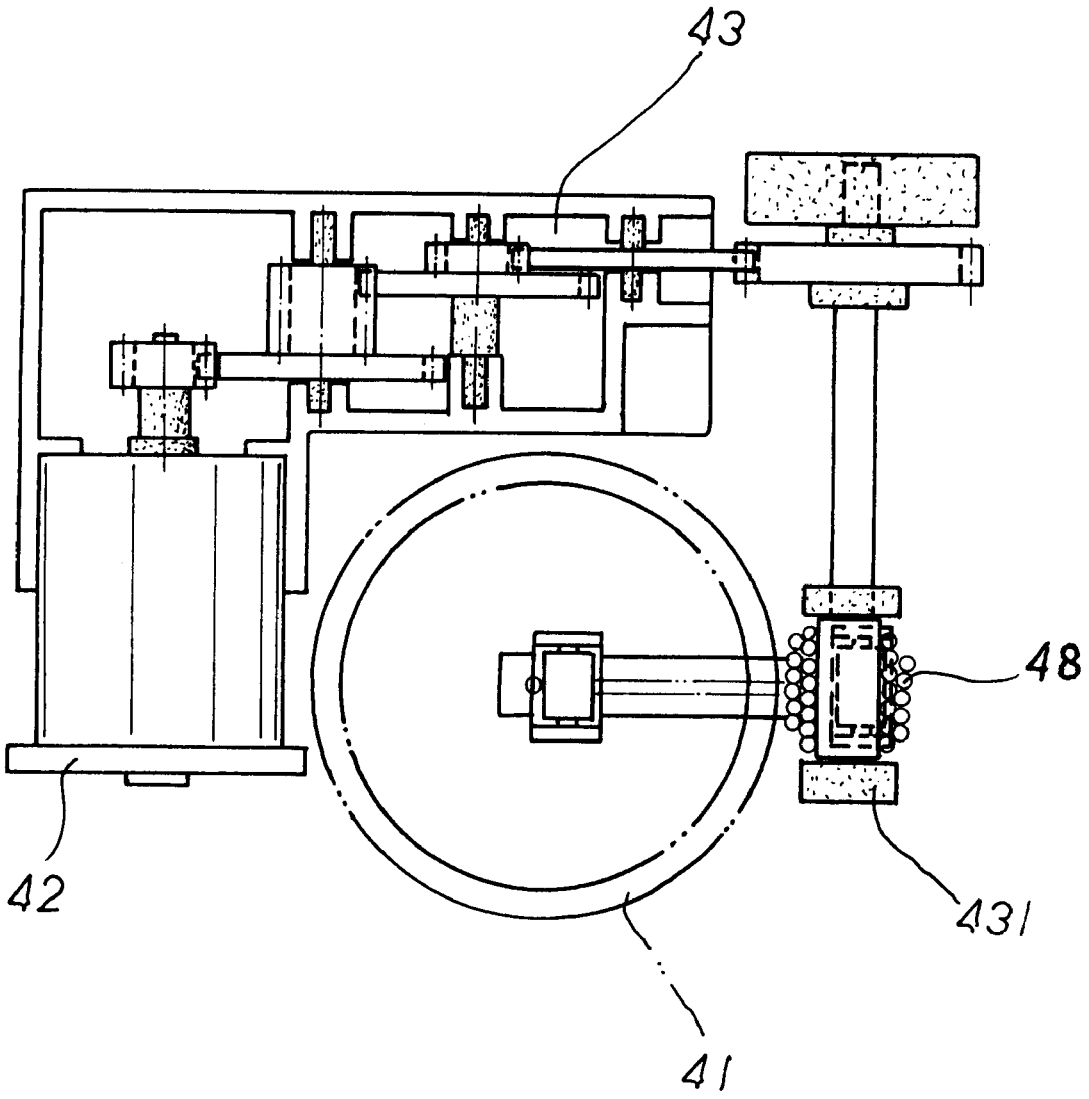
FIG. 11 is a top view of a part of the second drive unit shown in FIG. 10.
Figure 12:
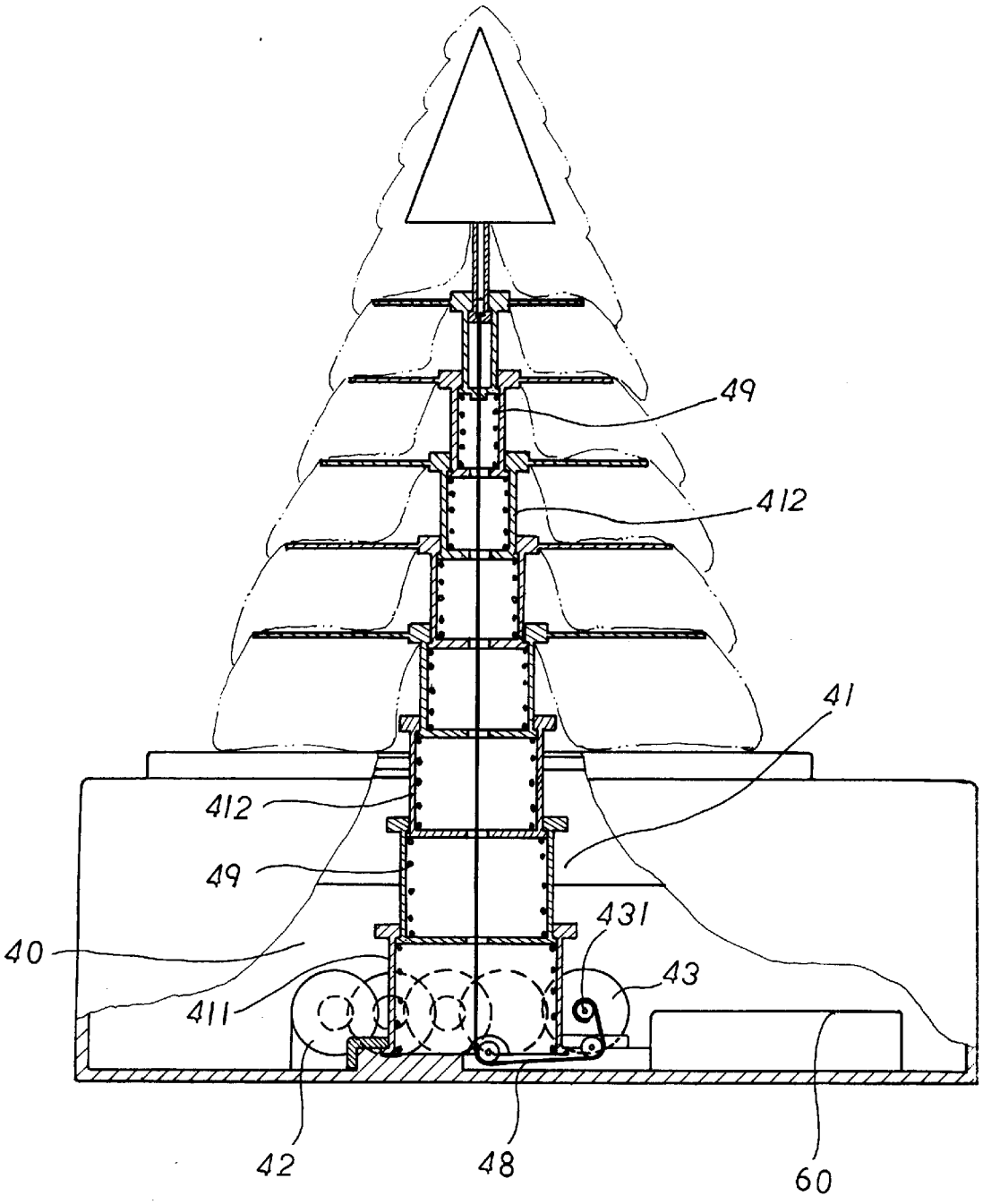
FIG. 12 shows the second drive unit operated, the telescopic rod of the telescopic device extended out of the top cover of the housing according to the second embodiment of the present invention.

FIGS. 10 and 11 show an alternate form of the second drive unit 40. According to this alternate form, the second drive unit 40 comprises a telescopic device 41, a reversible motor 42, a reduction gear set 43, a rope 48, and a plurality of springs 49. The telescopic device 41 is comprised of hollow base 411, and a telescopic rod 412 mounted in the hollow base 411 and made with parts that slide one inside another. The reversible motor 42 is controlled by the control circuit 60 to turn the reduction motor gear set 43. The reduction gear set 43 comprises an output wheel 431. The rope 48 has one end wound round the output wheel 431 of the reduction gear set 43, and an opposite end fixedly connected to the smallest part of the telescopic rod 412 of the telescopic device 41. The springs 49 are mounted in the telescopic rod 412 to push the parts of the telescopic rod 412 one out of another. When the motor 42 is rotated in one direction, the rope 48 is let off from the output wheel 431, enabling the parts of the telescopic rod 412 to be pushed one out of another by the springs 49 (see FIG. 12). On the contrary, when the motor 42 is rotated in the reversed direction, the rope 48 is taken up by the output wheel 431, causing the parts of the telescopic rod 412 to received one inside another (see FIG. 10).

It is to be understood that the drawings are designed for purposes of illustration only, and are not intended for use as a definition of the limits and scope of the invention disclosed.

What the invention claimed is:

1. A motion display toy comprising:

a housing, said housing comprising a casing and a top cover covered on said casing, said top cover having a center opening;

two sliding door panels mounted inside said housing and moved relative to each other to close/open the center opening at said top cover;

a telescopic device mounted inside said casing, and moved between a first position where said telescopic device is extended out of the center opening at said top cover, and a second position where said telescopic device is received inside said housing;

a control circuit;

first drive means controlled by said control circuit to move said sliding door panels; and second drive means controlled by said control circuit to move said telescopic device.

2. She motion display toy of claim 1 further comprising a power switch and a set of control buttons respectively mounted on said top cover and connected to said control circuit for controlling the operation of said control circuit.

3. The motion display toy of claim 1 wherein said first drive means comprises two racks respectively and fixedly mounted on said sliding door panels at a bottom side, two reduction gear sets respectively meshed with the racks at said sliding door panels, a reversible motor controlled by said control circuit to turn said reduction gear sets, a first actuating rod and a second actuating rod respectively provided at said sliding door panels at a bottom side, a first micro switch connected to said control circuit and driven by said first actuating rod to give a signal to said control circuit when said sliding door panels are opened, and a second micro switch connected to said control circuit and driven by said second actuating rod to give a signal to said control circuit when said sliding door panels are closed.

4. The motion display toy of claim 1 wherein said second drive unit comprises a flexible rack moved between a first position where said telescopic device is forced by said flexible rack to extend out and a second position where said telescopic device is pulled by said flexible rack to receive, a reversible motor controlled by said control circuit to move said flexible rack, a reduction gear set coupled between said flexible rack and said reversible motor, a first micro switch connected to said control circuit and triggered by said flexible rack to give a signal to said control circuit when said flexible rack is moved to the first position, and a second micro switch connected to said control circuit and triggered by said flexible rack to give a signal to said control circuit when said flexible rack is moved to the second position.

5. The motion display toy of claim 4 wherein said sliding door panels define a circular center hole when closed, and said control circuit is controlled by said control buttons to drive said first drive means in opening said sliding door panels, then to drive said second drive means, causing said telescopic device to extend out of the center opening at said top cover, and then to drive said first drive means in closing said sliding door panels again, enabling the extended portion of said telescopic device to be received in the circuit center hole at said sliding door panels.

6. The motion display toy of claim 1 wherein said second drive means comprises a plurality of spring members respectively mounted in said telescopic device to support said telescopic device in an extended condition, a reduction gear set, said reduction gear set comprising an output wheel, a rope coupled between said output wheel and said telescopic device, and a reversible motor controlled by said control circuit to turn said reduction motor gear set between two reversed directions, causing said output wheel to take up/let off said rope for enabling said telescopic device to be received, or forced to extend out by said spring members.

7. The motion display toy of claim 1 further comprising an annular rotary member mounted on said top cover around the center opening at said top cover, and third drive means controlled by said control circuit to rotate said annular rotary member.

8. The motion display toy of claim 7 wherein said third drive unit comprises a reversible motor controlled by said control circuit, a reduction gear set coupled to said reversible motor, a wheel driven to rotate said annular rotary member, and a transmission belt coupled between said wheel and said reduction gear set.

9. The motion display toy of claim 1 further comprising a battery box mounted inside said housing below said control circuit, and a battery installed in said battery box and connected to said control circuit.

10. The motion display toy of claim 7 wherein said annular rotary member comprises a plurality of ornamental items provided at a topside wall thereof.

11. The motion display toy of claim 1 wherein said telescopic device is decorated with ornamental means.

12. The motion display toy of claim 1 wherein said control circuit comprises a flashing circuit for controlling lamps means to flash, and voice recording and reproduction circuit means for recording voices and reproduction of recorded voices.

* * * * *